US005213414A

United States Patent [19]

Richard et al.

[11] Patent Number: 5,213,414

[45] Date of Patent: May 25, 1993

[54] MIXING APPARATUS

[75] Inventors: Bennett M. Richard, Kingwood; Michael H. Johnson, Spring, both of Tex.

[73] Assignee: Baker Hughes Incorporated, Houston, Tex.

[21] Appl. No.: 603,963

[22] Filed: Oct. 24, 1990

Related U.S. Application Data

[63] Continuation-in-part of Ser. No. 521,019, May 9, 1990, which is a continuation of Ser. No. 445,420, Dec. 12, 1989, Pat. No. 4,944,347.

[51] Int. Cl.[5] ..... B28C 5/38

[52] U.S. Cl. ..... 366/27; 366/34; 366/35; 366/38; 366/40; 366/51; 366/157

[58] Field of Search ..... 366/27, 28, 35, 34, 366/38, 40, 20, 50, 156, 157, 14, 158, 186, 10, 11, 51, 14, 196, 64; 166/70, 278, 75.1; 417/900

[56] References Cited

U.S. PATENT DOCUMENTS

| | | | |
|---|---|---|---|
| 2,014,770 | 9/1935 | Layne . | |
| 2,031,326 | 2/1936 | Miller | 366/20 |
| 2,349,062 | 5/1944 | Uren . | |
| 2,538,891 | 1/1951 | Zimmerman | 366/157 |
| 2,626,779 | 1/1953 | Armentrout . | |
| 3,469,394 | 1/1970 | Stogner et al. . | |
| 3,900,547 | 8/1975 | Hunt et al. . | |
| 4,068,831 | 1/1978 | Ebeling et al. . | |
| 4,232,973 | 11/1980 | Ligouzat . | |
| 4,384,787 | 5/1983 | Ito | 366/40 |
| 4,474,239 | 10/1984 | Colomb et al. . | |
| 4,551,024 | 11/1985 | Clapp | 366/50 |
| 4,574,880 | 3/1986 | Hanoke . | |
| 4,801,210 | 1/1989 | Gian . | |

FOREIGN PATENT DOCUMENTS

| | | | |
|---|---|---|---|
| 1916351 | 3/1969 | Fed. Rep. of Germany | 366/50 |

*Primary Examiner*—Robert W. Jenkins
*Attorney, Agent, or Firm*—Rosenblatt & Associates

[57] ABSTRACT

The apparatus allows mixing of a solid and a fluid continuously to facilitate downhole operations, especially gravel packing. The apparatus comprises a solids hopper, with preferably an internal auger, to meter the solids flowrate. The solids drop into a second feeder which empties into a mixing chamber. Liquid can be directed into an annular space formed in the mixing chamber around the periphery of the second auger, or could be piped into the second auger itself. A triplex pump is connected to the mixing chamber and draws the mixed solid and fluid and pumps it to sufficient pressures for use in a wellbore.

31 Claims, 4 Drawing Sheets

MIXING APPARATUS

This application is a continuation-in-part of copending application Ser. No. 521,019, filed on May 9, 1990, which is a continuation of U.S. Ser. No. 445,420, filed on Dec. 12, 1989 (U.S. Pat. No. 4,944,347).

FIELD OF THE INVENTION

This invention relates to an apparatus and method for creating slurries which can be used for a multitude of applications, including completion or workover systems in subterranean wells.

BACKGROUND OF THE INVENTION

During some aspects of the completion or workover of a subterranean oil, gas injection or disposal well, particularly in offshore areas, such as the Texas and Louisiana Gulf Coast area, it has been frequently found that the production zones are such that the produced fluid, whether it be oil or gas or mixtures thereof, will carry with it, through the subterranean well conduit and to the top of the well, solid matter, commonly referred to as "sand." Such abrasive solids are undesirable for a number of reasons. For example, erode surface equipment and flowlines and sand in the production fluids can cut seals in well tools, such as safety valves and the like, as well as adversely affect pumping action of well pumps and the like.

In the past, those skilled in the art have attempted to abate such production of sand within the production fluids by "gravel packing" the well. This procedure customarily has entailed the introduction of a larger solid, such as bauxite, sintered bauxite, glass beads, or gravel or similar solids into a pumpable fluid, such as water, brine, polymeric gel, or the like, at the top of the well, through the well, and deposited exteriorly around a screen system carried on the production conduit. The solid particulate gravel-packing matter is deposited in an annular area that is defined between the exterior of the screen assembly and the interior of the subterranean wellbore. Upon a deposition of such gravel-packing solids within such annular area, the carrier fluid is pumped through the screen, through the well conduit to the top of the well and may be recycled therethrough by introduction of additional gravel-packing solid matter thereto, until the well is satisfactorily gravel packed, with or without a screen.

In the past, there have been some problems in the preparation of such gravel-packing systems as well as systems in which a solid is to be blended or otherwise prepared for introduction into the well by a carrier fluid for fracturing, cementing and other completion/workover operations. Thus, reference to "completion/workover systems" refers to gravel packing, fracturing, cementing fluids which combine one or more solids in a carrier fluid. Typically, such systems have been prepared by first preparing the carrier fluid in a tank, pit, or the like, adjacent the well and by introduction of the gravel or other solid thereto. A propeller mixer, or the like, may be used for the blending operations. A pump, such as a triplex pump, has been utilized to pump the prepared system including the carrier fluid and the particulate matter, from the tank or pit into the subterranean well.

However, such procedure has been found to have several disadvantages, including the fact that such procedure is time-consuming and because the preparation of "blending" operation is, in effect, performed in a tank, pit, or the like, away from the pump, dead spots will occur in flowlines used to transport the prepared system and the pump itself, resulting in deposition of the particulate matter, thereby hindering the placement of the particulate matter in the subterranean well.

The present invention addresses the problems set forth above and provides a method and apparatus which reduce the dead spots in the pump and flowlines and provide agitation of the particulate matter within the carrier fluid during the actual mixing or preparation operation. The elimination of the dead spots additionally provides a uniform distribution of the particulate matter in the carrier fluid.

SUMMARY OF THE INVENTION

The apparatus allows mixing of a solid and a fluid continuously to facilitate downhole operations, especially gravel packing. The apparatus comprises a solids hopper, with preferably an internal auger, to meter the solids flowrate. The solids drop into a second feeder which empties into a mixing chamber. Liquid can be directed into an annular space formed in the mixing chamber around the periphery of the second auger, or could be piped into the second auger itself. A triplex pump is connected to the mixing chamber and draws the mixed solid and fluid and pumps it to sufficient pressures for use in a wellbore.

DETAILED DESCRIPTION OF THE PREFERRED EMBODIMENT

Figure 1:
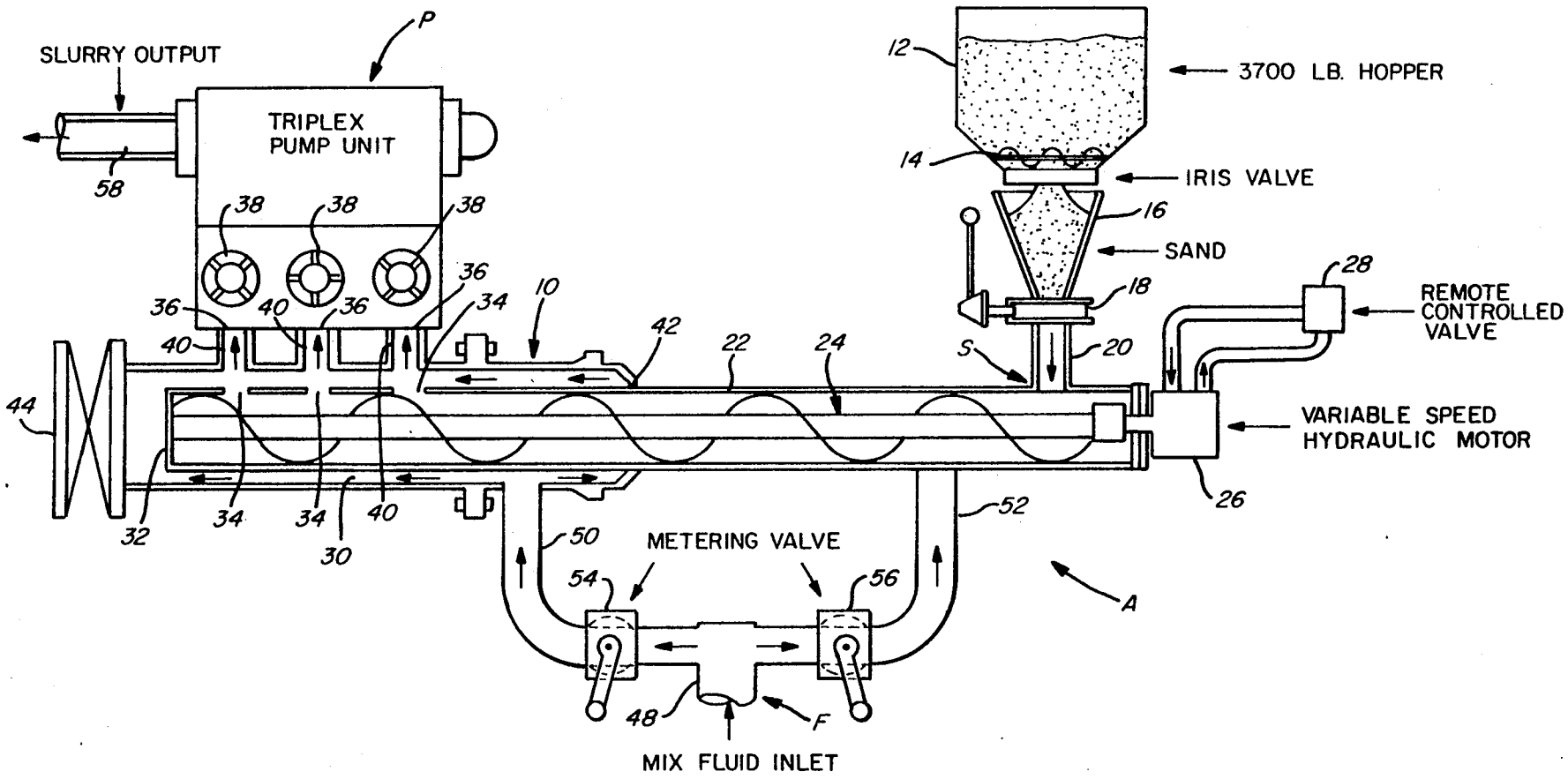
FIG. 1 is a schematic representation of the principal components of the apparatus.

The apparatus of the present invention is schematically illustrated in FIG. 1. The apparatus A comprises of a mixing chamber 10. Additionally, fluid feed means F and solids feed means S are also illustrated in FIG. 1. Pump means P is connected to mixing chamber 10.

More specifically, the solids feed means S comprises of a hopper 12. Hopper 12 is configured so that its contents are directed into, preferably, an integral auger 14. Auger 14 is typically a screw conveyor which can be equipped with a variable-speed drive, not shown, to adjust the solids output rate from hopper 12. After emerging from auger 14, the solid material enters a receiving chamber 16. A valve 18 is disposed at the lower end of receiving chamber 16. Valve 18 can have various designs such as a knife gate or a butterfly without departing from the spirit of the invention. Any valve style which can accommodate the potentially abrasive nature of the solid material and provide an effective seal is suitable for service as valve 18. Below valve 18 is a feed pipe 20. The feed pipe 20 preferably enters radially into housing 22. Located within housing 22 is conveyor 24, which is preferably of a screw conveyor type, but other types of conveyors can be employed without departing from the spirit of the invention. Located at one end of conveyor 24 is drive 26. In the preferred embodiment, the drive 26 is a hydraulic motor which can be remotely controlled from control 28, as shown schematically in FIG. 1.

It should also be noted that the solids in hopper 12 can be discharged by virtue of actuation of auger 14 directly into feed pipe 20 and into housing 22 without employing receiving chamber 16. However, the use of receiving chamber 16 allows the operator to visually determine that solids are, in fact, feeding out of hopper 12 and have not bridged or somehow jammed in or above auger 14 resulting in a cessation of the solids flow. It should also be noted that auger 14 need not be actuated in every case. The consistency and moisture content and flow characteristics of the solid material in hopper 12 will determine whether an auger 14 is actually necessary to move the solid material out of hopper 12. However, use of auger 14 for all materials presents additional advantages for several reasons. One the main reasons is the ability to regulate the flow rate of solids out of hopper 12. An additional reason is that, for materials that can stick or bridge, the auger 14 provides a mechanical means to move the solids in hopper 12 to the exit point 13 so that they may flow down by gravity into receiving chamber 16 (see FIG. 2). Auger 14 can have a suitable variable-speed drive 15 so that the operator of the apparatus A can pre-select the appropriate speed in conjunction with a pumping rate on pumping means P to achieve the required mix ratio of solid and liquid.

As shown in FIG. 1, housing 22 has an elongated shape, preferably round, and has a portion thereof which extends into mixing chamber 10. Mixing chamber 10 also has an elongated shape, which for ease of construction can be preferably made round, such that the segment of housing 22 which extends into mixing chamber 10 creates an annular flow space 30 therebetween. Housing 22 has a closed end 32. Typically, a bearing 33 for conveyor 24 is located directly outside closed end 32. In the preferred embodiment shown in the drawing, housing 22 has a plurality of outlets 34, which are radially disposed and preferably in longitudinal alignment. Alternatively, one outlet 34, having a generally oval shape, can be used instead of the plurality of openings 34. After the solids flow through feed pipe 20, they enter the helix of conveyor 24. In the preferred embodiment, the variable-speed hydraulic motor can rotate conveyor 24 at speeds of approximately 400 to 900 rpm. The higher speeds are preferred as will be later explained. As previously stated, the solids feed rate is determined by the speed of auger 14. The feed rate of solids from auger 14 will to some degree dictate the operational speed of conveyor 24. Generally, conveyor 24 is operated at a speed wherein it has a greater capacity than the feed rate from auger 14 to avoid back-ups of the solids in receiving chamber 16. The greater the speed of conveyer 24, the greater is the tendency of conveyor 24 to prevent fluid migration into openings 34 toward feed pipe 20.

Returning to openings 34, pump means P is preferably a triplex or three-cylinder pump of the type that is well-known in the art. This pump has separate inlets 36 for each of the cylinders 38. Mixing chamber 10 has a plurality of outlets 40 which extend radially from mixing chamber 10 and in substantial alignment with inlets 36.

Looking now at mixing chamber 10, it can be seen from FIG. 1 that it is sealed to housing 22 at point 42. At the opposite end of mixing chamber 10 is a valve 44.

Figure 4:
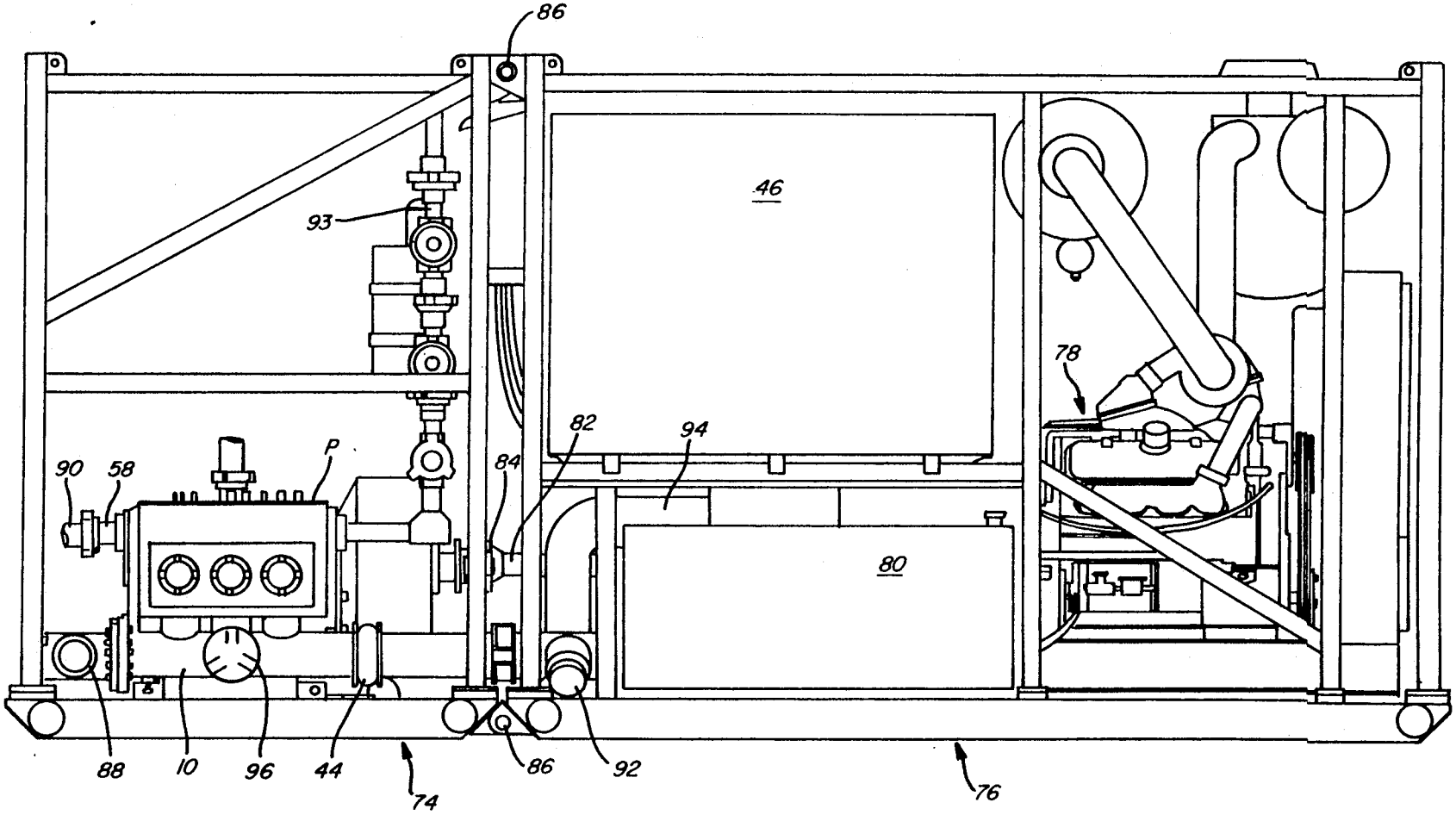
FIG. 4 is a sectional elevational view of the pump means and drive and portions of the liquid feeding means.

As shown in FIG. 4, fluid feed means F comprises of a fluid storage tank 46 which is connected to a pipe 48 (FIG. 1). Pipe 48 branches into segments 50 and 52. Manual or automatic valves 54 and 56 can be placed in pipes 50 and 52, respectively. The arrangement as shown in FIG. 1 allows for alternative direction of the fluid from fluid storage tank 46 into the annular flow space 30 in mixing chamber 10, into housing 22, or both, depending on the application. Specifically, when mixing sand and water, experience has shown that it is preferable to leave valve 54 open and valve 56 closed to direct the water into annular flow space 30. The high velocity of the water flowing in annular flow space 30 creates the mixing action within mixing chamber 10 prior to outlets 40. While conveyor 24 continuously moves the sand toward mixing chamber 10, some of the water can migrate back into housing 22 through openings 34. Experience has shown that during operation, the water actually migrates approximately mid-way back in housing 22 in the direction toward drive 26. The forward motion of the sand created by conveyor 24, as well as the rotation of the flights of conveyer 24, both act to direct any water which has migrated into openings 34 back toward the pump P. Normally, as shown in FIG. 4, the fluid storage tank 46 is located higher than pump P so that upon actuation of valves 54 or 56, flow begins into pipes 50 and 52 by gravity. The liquid flow rate is generally determined by the pumping rate of the triplex pump. The capacity of pump P is variable, depending upon the speed at which it is driven. There could arise conditions, depending on the pumping rate and sand concentration required, where it might be desirable to leave valve 54 only partially open. This is done so as to avoid unnecessary rearward migration of water within housing 22 to the point where water could back up out of receiving chamber 16. Again, as has been determined when mixing water and sand, it is preferable to leave valve 56 closed and open valve 54.

At times, different fluids are used to create the mixture. For example, the application may call for a mixture of sand with gel. Gel has a syrupy consistency with a high viscosity. To promote more uniform mixing, greater contact time is desirable between the gel and the sand prior to entering the pump P. When making such a slurry, it is preferable to leave valve 56 open and valve 54 closed to direct the gel into pipe 52 so that it enters housing 22 fairly close to feed pipe 20 and has substantially the length of housing 22 to thoroughly mix with the sand.

Pump P is preferably a pump rated at 10,000 lbs. output pressure to make it flexible enough for most well applications. A densimeter can be placed on the outlet 58 of pump P to measure the slurry concentration. Typical triplex pumps can handle water-sand slurries having up to approximately 17 lbs. of sand per gallon of water. However, most applications should require significantly lower concentrations in the order of 0.5 lb.–2 lbs. per gallon when pumping water-sand slurry. In some applications, particularly when dealing with extremely viscous materials as the fluid, it might be desirable to place a booster pump in pipe 48.

By adjusting the controls on pump P and auger 14, the concentrations can be changed during a gravel-packing procedure. Different carrier fluids can be used during gravel-packing operations, such as completion brines, acid or acid over flushes, gels (HEC or XC), or any combination of the above.

One of the advantages of the apparatus A of the present invention is that it provides uniform distribution of the gravel-pack sand. When using brine as a carrier fluid, uniform concentrations between 0 and 12 lbs. per gallon of sand can be provided. This uniformity also makes it possible to economize on the volume of completion fluid required to transport the sand, making possible reductions of up to 75 percent as compared to conventional known sand injectors. The actual assembly as will be described below is designed to be compact to take up less space on offshore locations than known conventional blending equipment. This minimizes rig time transportation and, therefore, overall completion costs to a well operator.

Figure 2:
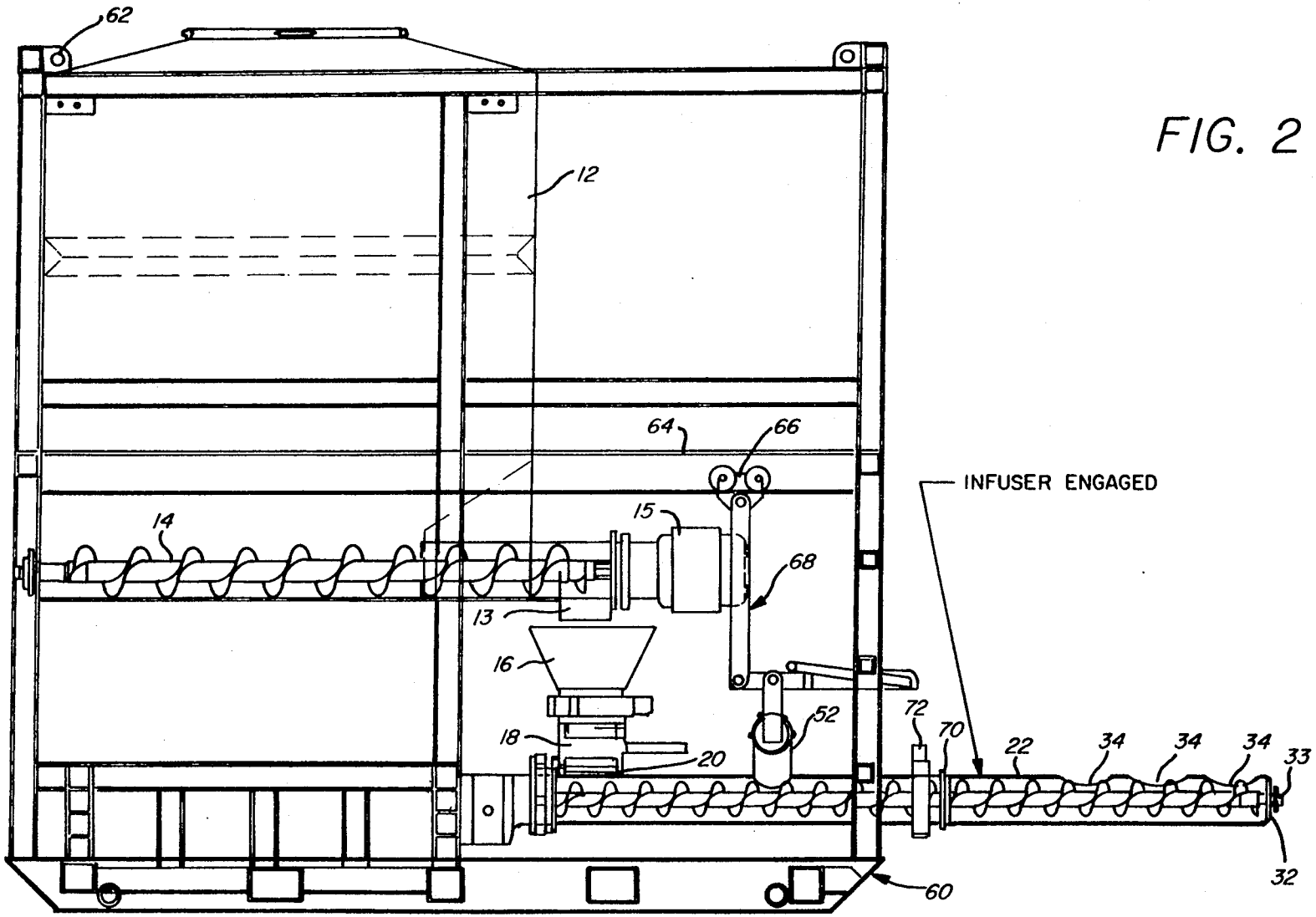
FIG. 2 is an elevational view, partly in section, of the solids feeding means in an extended position.
Figure 3:
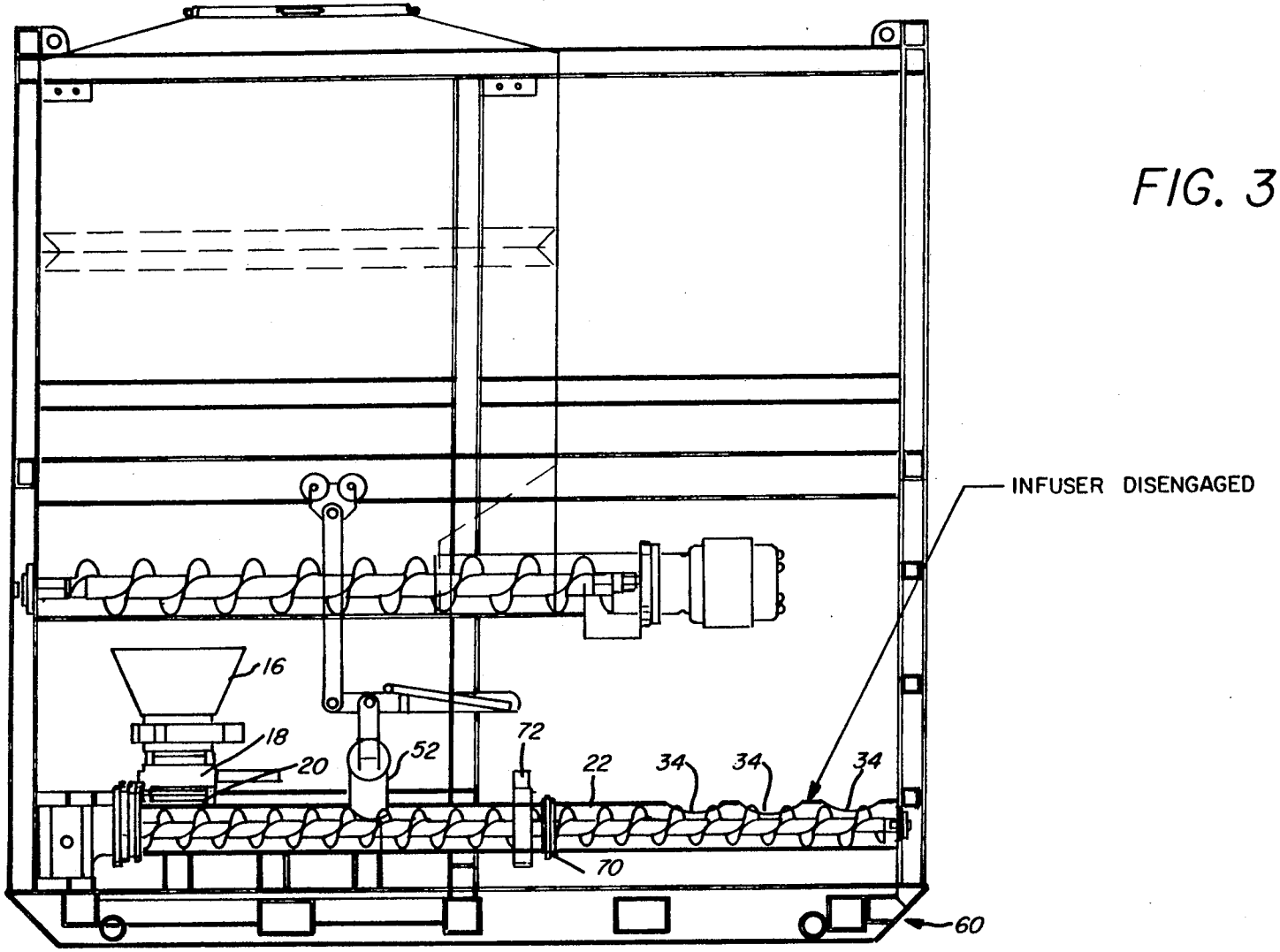
FIG. 3 is an elevational view, partly in section, of the solids feeding, means in a retracted position.

Referring now to FIGS. 2 and 3, a skid 60 is shown which holds hopper 12. The skid is designed with lifting eyes 62 to facilitate onloading and offloading to offshore platforms and rigs, as well as to load skid 60 on and off of trucks for land use. Skid 60 further includes trolley beam 64 and trolley 66. The position of housing 22 during transport is shown in FIG. 3. The position of housing 22 during use of the apparatus A is shown in FIG. 2. As shown in FIGS. 2 and 3, the entire housing 22, .including receiving chamber 16, valve 18, and feed pipe 20, are supported off of trolley 66 by linkage 68, which is attached to pipe segment 52 to allow vertical and horizontal adjustment. Housing 22 further contains a peripheral seal 70 and a hammer union 72. When housing 22 is put in the extended position shown in FIG. 2, hammer union 72 fits over seal 70 and attaches to mixing chamber 10, effectively sealing between the mixing chamber 10 and the housing 22. The annular flow space 30 is thus created, beginning from seal 70 and extending in the direction toward openings 34.

The space-saving economies recognized by using skid 60 can immediately be seen. The overall length of skid 60 is approximately the length of housing 22 by virtue of the use of the flexibly mounted housing 22 in combination with the trolley beam 64 and trolley 66 which allow a single operator to move housing 22 from the position shown in FIG. 3 to the position shown in FIG. 2 in order to activate the apparatus A. The resulting skid dimensions are approximately 8 ft by 6 ft by 7 ft high, with an approximately empty weight of 6,000 lbs.

Referring now to FIG. 4, it can be seen that there are two additional skids 74 and 76. Located on skid 76 is fluid storage tank 46. Located behind fluid storage tank 46 is a control panel (not shown) from which the various components on skids 60, 74, and 76 can be regulated. Also located on skid 76 is engine 78. Adjacent engine 78 is fuel tank 80. A transmission (not shown) is located directly behind fuel tank 80. The transmission connects the engine 78 to the drive shaft 82. At the end of drive shaft 82 is a universal joint 84. Skids 74 and 76 can be shipped unattached, in which case the universal joint 84 is connected to the pump P in the field. Alternatively, skids 74 and 76 can be pre-assembled and connected by pins 86, with the universal joint 84 preconnected when the skids 74 and 76 leave the shop. Skid 74 also includes the mixing chamber 10 and a connection 88 to accommodate pipe segment 50.

As shown in FIG. 4, pump P has an outlet 58 which is a common outlet which exits on two sides of the pump. In the configuration shown in FIG. 4, the outlet piping from pump P is connected to the lefthand outlet marked 581 The discharge piping is generally referred to as 90 and has a series of valves making it possible to direct the output of pump P to the suitable piping at the wellsite for completion of the gravel-packing or other procedure using the apparatus A. Line 93 is used to relieve well pressure off of pump P and into tank 46. At the site, an operator must hook a line from connection 92 to pipe segment 52 as shown in FIG. 2 and/or to connection 88 as shown in FIG. 4, depending on the application. Valve 44 can also be opened to allow direct access from fluid storage tank 46 through suction pipe 94, which is in fluid communication with connection 92 and valve 44. Typically, valve 44 is operated when pump P is at rates in excess of 3 barrels/minute. Those skilled in the art will appreciate the compact nature of the apparatus A as presented on skids 60, 74, and 76, as illustrated in FIGS. 2 and 4. Additionally, the apparatus A has been configured for a one-man operation.

In the preferred embodiment, the cross-sectional area of annular flow space 30 should not exceed about 20 percent of the internal diameter of the housing 22, which preferably is circular in cross-section. Those skilled in the art will appreciate that the drives for auger 14 and conveyor 24 can be many different types other than hydraulic without departing from the spirit of the invention. Once the system is placed into operation, the pump P is capable of delivering the slurry into a subterranean well for deposition of the gravel on a well screen in an annular area between the well screen and the casing. The carrier fluid then is circulated through the well and can be directed into a mud pit on the rig. The apparatus of the present invention is particularly adept at providing a uniformity of the blend, minimizing the presence of slugs of sand which in turn facilitates more efficient valve operation. The annular flow space 30 creates a sufficiently high velocity to transport the solids as they are introduced into the fluid stream and, in turn, through the pump. By virtue of the fact that there is a close proximity between the inlet to the mixing chamber at pipe segment 50 to the pump P, there isn't much time for the formation of dead spots and, accordingly, little opportunity for solids to drop out of the carrier fluid before entering the pump. While the cross-sectional area of annular flow space 30 should be kept small to promote fluid velocity, care must be given to avoid overly restricting the inlet flow passages into the pump P. For ease of maintenance and for cleaning out the lines, clean-out 96 is provided.

There could arise occasions where operation could involve fluid addition through pipe segments 50 and 52 simultaneously, or some combination of valve positions where any one, two, or three of valves 44, 54, and 56 are open during operation of the apparatus A.

The foregoing disclosure and description of the invention are illustrative and explanatory thereof, and various changes in the size, shape, and materials, as well as in the details of the illustrated construction, may be made without departing from the spirit of the invention.

We claim:

1. A mixing apparatus for creating a slurry of solids and at least one liquid, comprising:

an enclosed mixing chamber;

solids feed means connected to said mixing chamber for introducing solids therein;

pressurized fluid feed means for introducing through a conduit connected to at least said chamber at least one liquid under pressure to allow the energy of said pressurized liquid to suspend said solids therein creating a slurry within said mixing chamber;

said conduit further comprises inlet means to facilitate selective introduction of the liquid into said mixing chamber and/or to said solids feed means outside said mixing chamber.

2. The apparatus of claim 1, wherein said solids feed means further comprises:
a solids storage tank;
means for positively displacing the solids from said solids storage tank and into said mixing chamber.

3. The apparatus of claim 2, wherein:
said positive displacement means for the solids comprises:
a first conveyor mounted in flow communication with the solids storage tank.

4. The apparatus of claim 3, wherein said conveyor is a screw conveyor.

5. The apparatus of claim 3, wherein:
said solids feed means is located on a first skid;
said pump and mixing chamber are located on a second skid;
said solids feed means further comprises:
a second conveyor slidably mounted to said first skid and selectively movable between a retracted position where said second conveyor is fully within said first skid, and an extended position wherein said second conveyor extends into said mixing chamber on said second skid;
said first conveyor having an outlet in alignment with an inlet on said second conveyor when said second conveyor is in an extended position;
means for sealably engaging said second conveyor to said mixing chamber upon movement of said second conveyor into its extended position.

6. The apparatus of claim 1, further comprising pumping means connected to said mixing chamber for extracting the blended fluid and solids from said mixing chamber.

7. The apparatus of claim 6, wherein said solids feed means further comprises:
a solids storage tank;
means for positively displacing the solids from said solids storage tank and into said mixing chamber.

8. The apparatus of claim 7, wherein:
said positive displacement means for the solids comprises:
a first conveyor mounted in flow communication with the solids storage tank.

9. A mixing apparatus for solids and liquids, comprising:
an enclosed mixing chamber;
solids feed means connected to said mixing chamber for introducing solids therein;
pressurized liquid feed means for introducing through a conduit connected to at least said chamber at least one liquid under pressure to allow the energy of said pressurized liquid to suspend said solids therein creating a slurry within said mixing chamber;
said conduit further comprises inlet means to facilitate selective introduction of the liquid into said mixing chamber and/or to said solids feed means outside said mixing chamber;
said solid feed means further comprises:
a solids storage tank;
means for positively displacing the solids from said solids storage tank and into said mixing chamber;
said positive displacement means for the solids comprises:
a first conveyor mounted in flow communication with the solids storage tank;
said inlet means further comprises:
a piping manifold; and
means in said manifold to selectively direct fluid to said mixing chamber and/or said solids feed means.

10. The apparatus of claim 9, wherein said fluid feed means further comprises:
a fluid storage tank in fluid communication with said manifold; and said apparatus further comprises:
pumping means connected to said mixing chamber for extracting the blended fluid and solids from said mixing chamber.

11. The apparatus of claim 10, wherein:
said solids feed means is located on a first skid;
said pump and mixing chamber are located on a second skid;
said solids feed means further comprises:
a second conveyor slidably mounted to said first skid and selectively movable between a retracted position where said second conveyor is fully within said first skid, and an extended position wherein said second conveyor extends into said mixing chamber on said second skid;
said first conveyor having an outlet in alignment with an inlet on said second conveyor when said second conveyor is in an extended position;
means for sealably engaging said second conveyor to said mixing chamber upon movement of said second conveyor into its extended position.

12. The apparatus of claim 11, further comprising:
retention means on said first skid to selectively retain said second conveyor in said retracted position.

13. A mixing apparatus for solids and liquids, comprising:
a mixing chamber;
solids feed means connected to said mixing chamber for introducing solids therein;
fluid feed means for introducing fluids to allow he fluid and solids to mix within said mixing chamber;
said fluid feeds means further comprises inlet means to facilitate selective introduction of the fluid into said mixing chamber and/or to said solids feed means outside said mixing chamber;
pumping means connected to said mixing chamber for extracting the blended fluid and solids from said mixing chamber;
said solid feed means further comprises:
a solids storage tank;
means for positively displacing the solids from said solids storage tank and into said mixing chamber;
said positive displacement means for the solids comprises:
a first conveyor mounted in flow communication with the solids storage tank;
said inlet means further comprises:
a piping manifold;
means in said manifold to selectively direct fluid to said mixing chamber and/or said solids feed means.

14. The apparatus of claim 13, wherein:
said solids feed means is located on a first skid;
said pump and mixing chamber are located on a second skid;
said solids feed means further comprises:
a second conveyor slidably mounted to said first skid and selectively movable between a retracted position where said second conveyor is fully within said first skid, and an extended position wherein said second conveyor extends into said mixing chamber on said second skid;

said first conveyor having an outlet in alignment with an inlet on said second conveyor when said second conveyor is in an extended position;

means for sealably engaging said second conveyor to said mixing chamber upon movement of said second conveyor into its extended position.

15. The apparatus of claim 14, further comprising:

retention means on said first skid to selectively retain said second conveyor in said retracted position.

16. A mixing apparatus comprising:

a first skid;

solids feed means for feeding solids off of said first skid;

a second skid;

a mixing chamber on said second skid;

said solids feed means having at least a portion thereof slidably mounted for extension beyond said first skid into sealable engagement with said mixing chamber on said second skid;

liquid feed means for feeding in a liquid into the flowpath of the solids for mixing therewith.

17. The apparatus of claim 16, further comprising:

pumping means connected to said mixing chamber for extracting the blended fluid and solids from said mixing chamber.

18. The apparatus of claim 17, wherein said fluid feed means further comprises inlet means to facilitate selective introduction of the fluid into said mixing chamber and/or to said solids feed means outside said mixing chamber.

19. The apparatus of claim 18, wherein said solids feed means further comprises:

a solids storage tank;

means for positively displacing the solids from said solids storage tank and into said mixing chamber.

20. The apparatus of claim 19, wherein:

said positive displacement means for the solids comprises:

a first conveyor mounted in flow communication with the solids storage tank.

21. The apparatus of claim 20, wherein said inlet means further comprises:

a piping manifold;

means in said manifold to selectively direct fluid to said mixing chamber and/or said solids feed means.

22. The apparatus of claim 16, wherein said fluid feed means further comprises inlet means to facilitate selective introduction of the fluid into said mixing chamber and/or to said solids feed means outside said mixing chamber.

23. The apparatus of claim 22, wherein said solids feed means further comprises:

a solids storage tank;

means for positively displacing the solids from said solids storage tank and into said mixing chamber.

24. The apparatus of claim 23, wherein:

said positive displacement means for the solids comprises:

a first conveyor mounted in flow communication with the solids storage tank.

25. The apparatus of claim 24, wherein said inlet means further comprises:

a piping manifold;

means in said manifold to selectively direct fluid to said mixing chamber and/or said solids feed means.

26. The apparatus of claim 25, further comprising:

pumping means connected to said mixing chamber for extracting the blended fluid and solids from said mixing chamber.

27. A mixing apparatus for solids and liquids, comprising:

an enclosed mixing chamber;

solids feed means connected to said mixing chamber for introducing solids therein;

pressurized liquid feed means for introducing through a conduit connected to at least said chamber at least one liquid under pressure to allow the energy of said pressurized liquid to suspend said solids therein creating a slurry within said mixing chamber;

said conduit further comprises inlet means to facilitate selective introduction of the liquid into said mixing chamber and/or to said solids feed means outside said mixing chamber;

said inlet means further comprises:

a piping manifold; and means in said manifold to selectively direct fluid to said mixing chamber and/or said solids feed means.

28. A solid/liquid mixer comprising:

a mixing chamber;

means for feeding in solids into and through said mixing chamber;

means for feeding in liquids into the flowpath of said solids feeding means;

pump means connected to said mixing chamber, having an inlet to draw from said mixing chamber the mixture of said solids and liquids;

said solid feeding means is a conveyor, a portion of which is disposed within said mixing chamber;

said inlet of said pump means is disposed in said mixing chamber adjacent one end of said conveyor;

said conveyor is a screw disposed in a housing, a portion of which extends into said mixing chamber, thereby creating a peripheral flow zone therebetween;

said conveyor has a solids entry point outside said mixing chamber and adjacent the opposite end of said conveyor from said inlet of said pump means;

said housing is formed having at least one outlet in substantial alignment with said inlet of said pump means, the fluids flowing through said peripheral flow zone and initially mixing with the solids adjacent said outlet in said housing to provide a mixture of solid and fluid into the inlet of said pump means;

said pump means is a triplex positive-displacement pump comprising of three cylinders, in flow communication with said inlet, and said housing has at least one opening within said mixing chamber in alignment with said inlet to said three cylinders of said pump.

29. A solid/liquid mixer comprising:

a mixing chamber;

means for feeding in solids into and through said mixing chamber;

means for feeding in liquids into the flowpath of said solids feeding means;

pump means connected to said mixing chamber, having an inlet to draw from said mixing chamber the mixture of said solids and liquids;

said means for feeding in solids further comprising a housing, a portion of which extends into said mixing chamber, thereby creating a peripheral flow zone therebetween;

said pump means is a triplex positive-displacement pump comprising of three cylinders, in flow communication with said inlet, and said housing has at least one opening within said mixing chamber in alignment with said inlet to said three cylinders of said pump.

30. A mixing apparatus for creating a solid and liquid slurry, comprising:

an enclosed mixing chamber having a solids inlet;

means for feeding in solids into said inlet and through said mixing chamber for introducing solids;

pressurized liquid feed means for introducing through a conduit connected to at least said chamber at least one liquid under pressure to allow the energy of said pressurized liquid to suspend said solids therein, creating a slurry within said mixing chamber;

pump means connected to said mixing chamber, having an inlet to draw from said mixing chamber the mixture of said solids and liquids;

said solid feeding means is a conveyor, a portion of which is disposed within said mixing chamber;

said inlet of said pump means is disposed in said mixing chamber adjacent one end of said conveyor; and said conveyor has a solids entry point outside said mixing chamber and adjacent the opposite end of said conveyor from said inlet of said pump means;

said conveyor is a screw disposed in a housing, a portion of which extends into said mixing chamber, thereby creating a peripheral flow zone therebetween;

said liquid feeding means is in a flow communication with said housing of said conveyor outside said mixing chamber.

31. A mixing apparatus for creating a solid and liquid slurry, comprising:

an enclosed mixing chamber having a solids inlet;

means for feeding in solids into said inlet and through said mixing chamber for introducing solids;

pressurized fluid feed means for introducing through a conduit connected to at least said chamber at least one liquid under pressure to allow the energy of said pressurized liquid to suspend said solids therein, creating a slurry within said mixing chamber;

pump means connected to said mixing chamber, having an inlet to draw from said mixing chamber the mixture of said solids and liquids;

said solid feeding means is a conveyor, a portion of which is disposed within said mixing chamber;

said liquid feeding means is in flow communication with said conveyor outside said mixing chamber.

* * * * *